United States Patent [19]

Ostkamper et al.

[11] Patent Number: 4,784,229

[45] Date of Patent: Nov. 15, 1988

[54] DEVICE, PREFERABLY FOR UNDERGROUND PURPOSES, TO TRANSFER INFORMATION OUT OF A DRILLING HOLE

[75] Inventors: Michael Ostkamper, Bochum; Heinz Wallussek, Herdecke, both of Fed. Rep. of Germany

[73] Assignees: Schwing Hydraulik Elektronik GmbH, Herne; Bergwerksverband GmbH, Essen, both of Fed. Rep. of Germany

[21] Appl. No.: 132,613

[22] Filed: Dec. 10, 1987

Related U.S. Application Data

[63] Continuation of Ser. No. 902,294, Aug. 29, 1986, abandoned.

[30] Foreign Application Priority Data

Aug. 31, 1985 [DE] Fed. Rep. of Germany ..... 3531226

[51] Int. Cl.[4] ..... E21B 44/00

[52] U.S. Cl. ..... 175/45; 175/48

[58] Field of Search ..... 175/24, 25, 26, 27, 175/38, 45

[56] References Cited

U.S. PATENT DOCUMENTS

| | | | |
|---|---|---|---|
| 4,044,834 | 8/1977 | Perkins | 175/38 |
| 4,407,374 | 10/1983 | Wallussek et al. | 175/24 |
| 4,470,430 | 9/1984 | Lancaster | 175/38 |
| 4,535,429 | 8/1985 | Russell et al. | 175/48 |
| 4,596,293 | 6/1986 | Wallussek et al. | 175/27 |

FOREIGN PATENT DOCUMENTS

| | | |
|---|---|---|
| 2941102 | 4/1981 | Fed. Rep. of Germany . |
| 3000239 | 7/1981 | Fed. Rep. of Germany . |
| 2161353 | 7/1982 | Fed. Rep. of Germany . |
| 3028813 | 9/1983 | Fed. Rep. of Germany . |

*Primary Examiner*—Jerome Massie, IV
*Assistant Examiner*—William P. Neuder
*Attorney, Agent, or Firm*—Price, Heneveld, Cooper, DeWitt & Litton

[57] ABSTRACT

A choker valve assembly for a drill string is provided for transmitting information measured in an underground bore hole by sensing devices, to the surface by modulating the pressure of the flushing fluid. The valve assembly includes a housing that is non-rotatably connected within the flushing fluid flow passage by cross-pieces extending between the housing and a portion of the inner pipe wall. A drag body valve element is mounted by the housing and is axially displaceable with respect to a tapered restriction portion of the inner pipe. Drive means for displacing the valve element is located outside the housing and extends between the valve element and the pipe wall through the cross-pieces. A cap is provided on each end of the valve element. The cap facing the direction of flushing fluid flow extends beyond the perimeter of the housing and the cap facing away from the direction of flushing fluid flow is entirely within the perimeter of the housing to provide a hydrodynamically pressure-compensated choker valve assembly.

17 Claims, 4 Drawing Sheets

DEVICE, PREFERABLY FOR UNDERGROUND PURPOSES, TO TRANSFER INFORMATION OUT OF A DRILLING HOLE

This is a continuation of co-pending application Ser. No. 06/902,294, filed on Aug. 29, 1986, now abandoned.

FIELD OF THE INVENTION

The invention pertains to a device, meant in particular for underground operation, for long-range transmission of information from a bottom end of a drill for a well.

BACKGROUND OF THE INVENTION

A device of this kind is known from patent DE-PS 30 28 813. In order to generate pressure pulses, a choker valve is installed in the drill pipe in such a manner that the flushing liquid flows towards and around it. All the attachments necessary to drive the choker valve, plus the choker valve itself, constitute an individual structural part of the equipment. Power to operate the choker valve is supplied via channels that run through the cross-pieces which connect the choker valve to the wall of the casing pipe. The cross-pieces lie in the flushing liquid flow. In the case of a drill pipe, such as is known from patent DE-PS 21 61 353, it is usually the flushing liquid which drives the drill bit, via a turbine. Since, however, the flushing liquid is mixed with drillings, the cross-pieces and the turbine are exposed to the very abrasive flow action which quickly leads to their destruction. If the use of a turbine is dispensed with, i.e. that the drill pipe itself is used to drive the core bit, then the drive units for the choker valve, as well as the transmission elements for the signals from the measuring devices to the choker valve, are exposed to heavy stress due to the drilling activity and the rotary motion.

At the present state of technology, a version of a rotating drill pipe is already known, where—in the area of the core barrel—a rotatable inner pipe has been installed in a stationary outer pipe. This part of the drill pipe is also called a target drill rod. Generally speaking, a target drill rod is a casing pipe that is installed in the string of drill pipes, and which receives and transmits the measuring data which originate from the measuring devices and monitors in the target drill rod. Whereas the measuring data give information about the course of the drill hole, i.e. about possible deviations from a desired direction of the drilled well, the monitors deliver measuring data which make it possible to check the functions of the various devices of such a targeet drill rod. Furthermore, the monitors are provided with a device which allows the correction of the drill hole. As a rule, such a device consists of several pivotable control bars, installed on the outer pipe, and which are supported by the joints of the well. They are individually adjustable by means of hydraulically loadable cylinders, and serve to correct the direction of the drill pipe. Such a target drill rod is known, for instance, from patent DE-OS 30 00 239.2. Usually, several, though preferably two bore hole deviation-measuring devices are installed—on vertical measuring planes which are at right angles to each other—in the outer pipe of the target drill rod. These serve to control the hydraulically-loaded adjustment cylinders of the control bars. The data from these bore hole deviation measuring devices not only supplies the input variables of the built-in, automatic control bar adjustment, but are transmitted—by means of the telemetric device—to the control post installed at the well mouth. This telemetric device operates with electric signals which are transmitted via a conductor that is installed either in a trailing cable or in the drill hole itself. The signals, transmitted in this manner, are sufficiently accurate, since they are generated and transmitted by an energy source that is independent of the flushing flow. This energy source supplies the energy for the signal and can also drive the pressure generator, if same generator does not receive its kinetic energy directly from the rotating inner pipe. Even though a battery can also serve as an energy source, it is preferable to have a generator whose rotors are driven by the rotating inner pipe. The conductor connection needed for the transmission of the signals is not very desirable. If placed in the drill pipe, it is difficult to establish and maintain satisfactory physical contact between the casing pipes. If the telemetric device uses a trailing cable, then—though the electrical connection will be satisfactory—it will be exposed to all mechanical as well as other stresses which result from the rotating string of drill pipes, the drill hole joints, and the drill hole flushing.

Furthermore, a target drill rod in the manner of a drill stem and constructed as a rotating casing pipe, is known from patent DE-OS 29 41 102. In this type, the telemetric device is the flushing flow proper that passes through the flushing channel, and a hydraulic converter which transforms the electric signals into pressure impulses of the flushing flow. The thus pressure-modulated flushing flow can be measured at the drill hole exit; and, thus, the pressure impulses can be captured by a receiver which, for forwarding purposes, will convert them into electrical quantities. A poppet valve in the drill stem serves as a transformer for the pressure modulation of the flushing flow as well as for throttling the flushing flow. The poppet valve is activated by a built-in, self-contained hydraulic cycle. The control of the hydraulic means is effected with the aid of a solenoid valve that is loaded with the electric deviation data.

Such a telemetric device presupposes an axial location of the poppet valve, i.e. that the valve body be concentrically located in a flushing channel that leads the flushing flow past the poppet valve, behind the restrictor. On the one hand, this results in a space problem when the casing pipe in which the flushing channel runs has relatively thin walls. This is especially the case when the inner pipe of a target drill rod has a stationary outer pipe. On the other hand, a stationary outer pipe is not feasible when casing pipes with walls of an adequate thickness are used. This requires that the power generator be put in the rotating casing pipe and, thus, would need a flushing-flow-driven turbine for driving the generator. Due to the pressure-modulated flushing flow and other quantities which influence it, this turbine causes faulty formation of the electric signals that are to be transmitted. The result is that if the pressure signals are produced and transmitted by means of the known device, these signals are marked by an irregular, or at least slow pressure rise and drop. This is detrimental since it not only makes difficult the perception of the pressure signals but it also keeps the signal frequency low and, thus, lessens the accuracy of the data transmitted in this manner.

SUMMARY OF THE INVENTION

Therefore, it is the endeavour of the invention to perfect a device, such as mentioned at the beginning, which will provide:

(a) that on a drill pipe suitable for target drilling, the driver units for driving the choker valve are to be located—for the purpose of protecting them against the abrasive flushing liquid—outside of same drill pipe, in an area of the drill pipe that is less exposed to the stress, vibrations and bearing pressure resulting from the drilling activity, and (b) that the signals produced by the built-in electrohydraulic equipment will be transmitted with the necessary accuracy.

Thanks to the invention, it is possible—for the first time—for a target drill rod with a rotating inner pipe and a stationary outer pipe to be combined with a choker valve installed in the inner pipe. The power needed to operate the measuring devices, control bars, etc. which are located on the target drill rod, is produced either by a generator which is driven by the rotating inner pipe, or by an electirc motor. The electrically measured impulses are converted by the choker valve into a sequence of pressure pulses which are transmitted by the flushing liquid. The pressure pulses, received at the drill mouth, are re-converted into electric impulses by means of a measuring transformer. The pulses convey informtion about the position of the target drill rod, and make it possible to correct the drilling direction. The application of this principle to a target drill rod that is built according to the basic construction as per the invention, becomes viable only through the miniaturization of the transformer which permits the transformer to be housed under the prevailing limited space conditions, while ensuring—at the same time—that the pressure impulses will be in the desired form. This miniaturization of the transformer is done by shifting to the outer pipe all those parts and structural components which are located behind the choker valve. This particular arrangement and construction of the choker valve makes it possible to produce pressure impulses which lend themselves to an exact evaluation. The invention has the advantage that, apart from the signals provided by the deviation measuring devices, a plurality of additional data can be transmitted from the target drilling rod to the outside, above ground. At the same time, it is possible to house the necessary measuring devices and monitors in the outer pipe which, being stationary, is relatively less exposed to mechanical stress. Thus only the signals they transmit to the choker valve are conveyed to the flushing flow, after these signals have been converted into hydraulic or mechanical impulses. The choker valve according to the invention consists of: (a) a basic body of ring-shaped construction which is connected to the inner pipe in a twist-proof manner, and whose tapered end—facing in the direction the flow approaches—serves as the valve seat, and (b) a hollow piece or valve housing, open at both ends, concentrically positioned in the basic body and connected to the same by means of cross-pieces and, housed in it, an axially displaceable drag body or valve element that is sealed against this housing. A driver unit in the outer pipe activates the drag body in accordance with the measured data. The drag body, in interaction with the valve seat, causes the cross section of the flow path of the flushing liquid to vary. In order to protect the means for transmitting the converted measuring data against the abrasive flushing liquid, they are placed in the cross-pieces. Thus, merely the drag body and the cross-pieces are exposed to the flow of the flushing liquid, while all the delicate devices, such as the measuring instruments, transformer, choker valve drive and the power supply are either placed in the less stress-exposed outer pipe, or in areas which are seal-protected against the flushing liquid flow.

It is advantageous to construct the drag body's ends in the form of streamlined caps, slidable in the axial direction, and mount the cap facing in direction of the approach of the flow of flushing liquid in the housing, and the cap facing in the flow-off direction inside the housing. Thus, the abrasive flow will meet with the least possible resistance. The choker valve may be driven, by either an internal hydraulic or a pneumatic power supply, inside by which the drag body can be activated—via bore holes in the inner pipe and in the cross-pieces of the housing—by means of a pressure-transmitting medium located in the outer pipe. The drag body has two chambers which are hermetically sealed against each other, and one bore hole opening into each of the chambers. If the chamber facing in the direction from which the flow approaches receives hydraulic (or pneumatic) pressure, the cap will slide toward the valve seat and will thus reduce the flow's cross-section or choke it off altogether. The cap seated against the outer end of the housing.

Another form of construction according to the invention provides for the drag body to be operated by means of levers which act upon the drag body, and which are activated by drives positioned in the outer pipe. The levers may be constructed in the form of fork rockers which can be applied via the cross-pieces and are supported by the housing. The drive activates the fork rockers and they, in turn, activate a piston positioned in the housing. This piston displaces the caps in, or against, the direction of the flow. Instead of fork rockers, it is also possible to have rigid connections between the drive and the drag body act as levers. A hydraulically or pneumatically driven rotary piston, located in the outer pipe, is provided as the drive for the levers. The lever ends facing towards the drive are connected to a rotary bearing whose stationary part is attached to the rotary piston. The lever ends facing towards the drive may also be activated by electro-mechanical or electro-magnetic means, and, taking this yet one step further, the drag body can also be activated directly by electro-mechanicl or electro-magnetic means.

Below follows a more detailed description, based on drawings, of typical models and additional advantages of the invention.

DESCRIPTION OF THE PREFERRED EMBODIMENT

Figure 1:
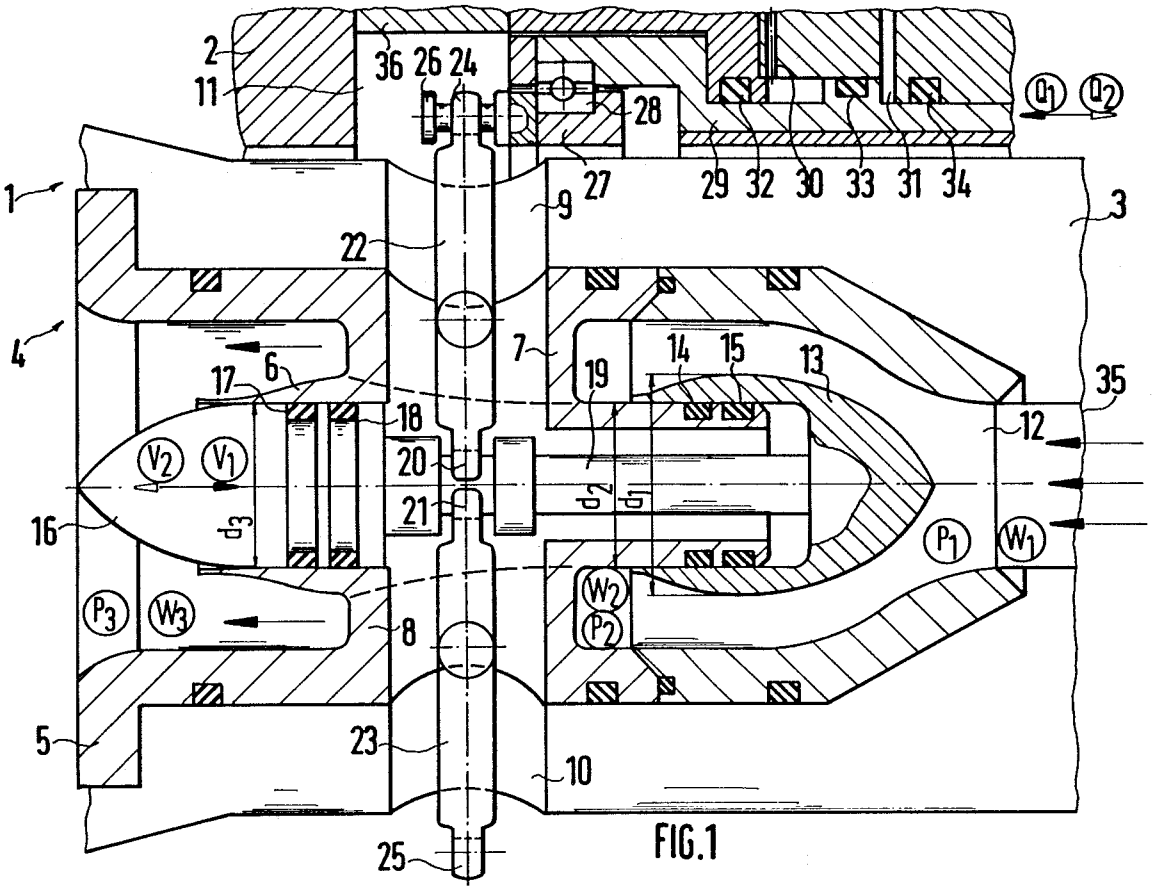
FIG. 1 is a sectional view of a target drill rod with a lever actuated choker valve arranged inside it.

FIG. 1 shows a target drill rod bearing the general reference number 1. It consists of an outer pipe 2 which is stationary in the drill hole, and which is fitted, on its outside, with pivotally-mounted control bars (not shown) supported by the drill hole joints. The bars can be individually adjusted to correct the direction of the drill pipe by means of hydraulically loadable cylinders. An inner rotatable pipe 3 is supported by the outer pipe 2. A choker valve, bearing the general reference number 4, is concentrically positioned and twist-proof connected to an inner pipe 3. The choker valve 4 consists of a ring-shaped basic piece 5, in which a housing 6 is concentrically positioned. The housing 6 is connected to the basic piece 5 by means of cross-pieces 7 and 8. The cross-pieces 7 and 8 are of hollow construction and align with the apertures 9 and 10 in the inner pipe 3. The apertures 9 and 10 open into chambers 11, which are positioned in ring-like fashion, around the inner pipe 3 in the outer pipe 2. The basic piece 5 is open at both ends, one side 12 being tapered. The housing 6 is also open at both ends. On the outer surface of the housing 6, namely at the end that faces the tapered side 12 of the basic piece 5, is mounted a streamlined, slidable cap 13 which is sealed against the housing by means of O-rings 14 and 15. At its other end, the housing 6 is provided with a further cap 16 which, however, operates like a piston in the cylinder that is created by the end of the housing O-rings 17 and 18 seal the cap 16 against the housing 6. The caps 13 and 16 are connected by a rod 19. The ends 20 and 21, which face the output side and are actually levers, constructed in the form of fork rockers, engaging the rod 19 at the point where the rod passes through the cross-piece area. The fork rockers 22 and 23 are pivotally attached to the basic piece 5. The ends 24 and 25 of the fork rockers 22 and 23—facing the drive—are fastened by pins 26. The pins 26 are located on a ring 27, circling the inner pipe 3. The ring is mounted on the rotary bearing 28 which is fastened to a rotary piston 29. The rotary piston 29 can be displaced only in the axial direction. The rotary piston 29 is pressurized via the pressure-conducting channels 30 and 31, for instance. With the aid of seals 31, 32, 33 and 34, the rotary piston and the pressure-conducting channels are sealed against the outer pipe 2. If the rotary piston 29 is displaced in one direction in the annular chamber or annulus 11, the fork rockers 22 and 23 will then displace the rod 19 in the opposite direction. The rod 19, whose ends bear the caps 13 and 16, thus displaces the caps 13 and 16 in the direction of the tapered aperture 12 in the basic piece 5. In an extreme case, the cap 13 will come to rest upon the aperture 12. The aperture 12 opens into the flushing liquid channel 35 which leads flushing liquids from the drill hole mouth (not shownA) to the core barrel (not shown either). The flushing liquid flows towards the cap 13, past it, and past the housing 6 and the cap 16, to the core barrel. The measuring devices (not shown) in the outer pipe 2, which receive the measuring data pertaining to the target drill rod and its direction, forward this data to a converter (not shown) in the outer pipe 2. The converter converts the electric impulses into hydraulic impulses, which—via the channels 30 and 31—activate the rotary piston 29. Activation of the rotary piston 29 causes the caps 13 and 16 to be displaced, thus effecting cross sectional changes in the cross section of the flushing flow. This causes the pressure pulses to be transmitted to the flushing liquid flow, and to be captured and processed at the drill hole mouth. Cover 36 provides access to the annulus 11, be it for the installation or the servicing of the fork rockers.

Figure 2:
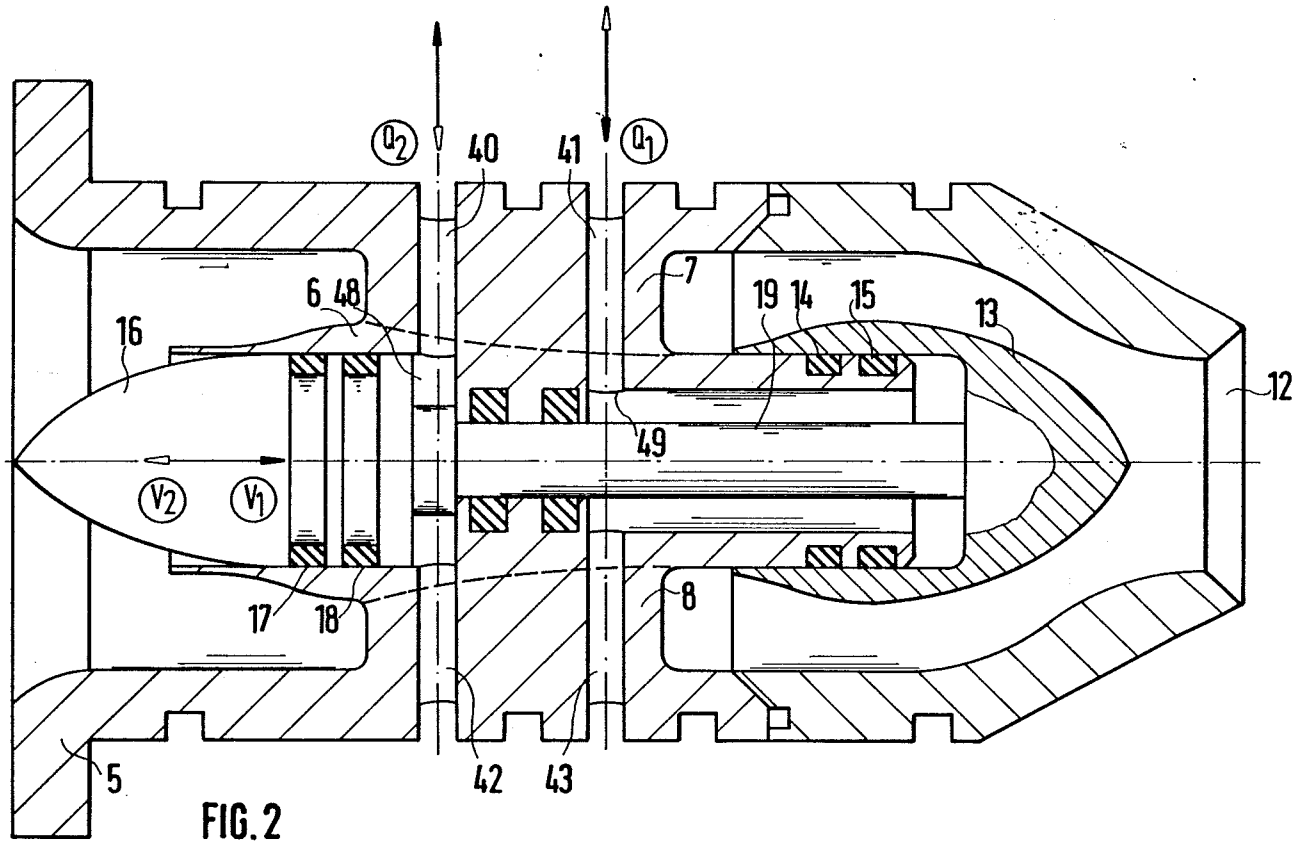
FIG. 2 is a sectional view of a target drilling rod with a fluid pressure activated choker valve arranged inside it.
Figure 3:
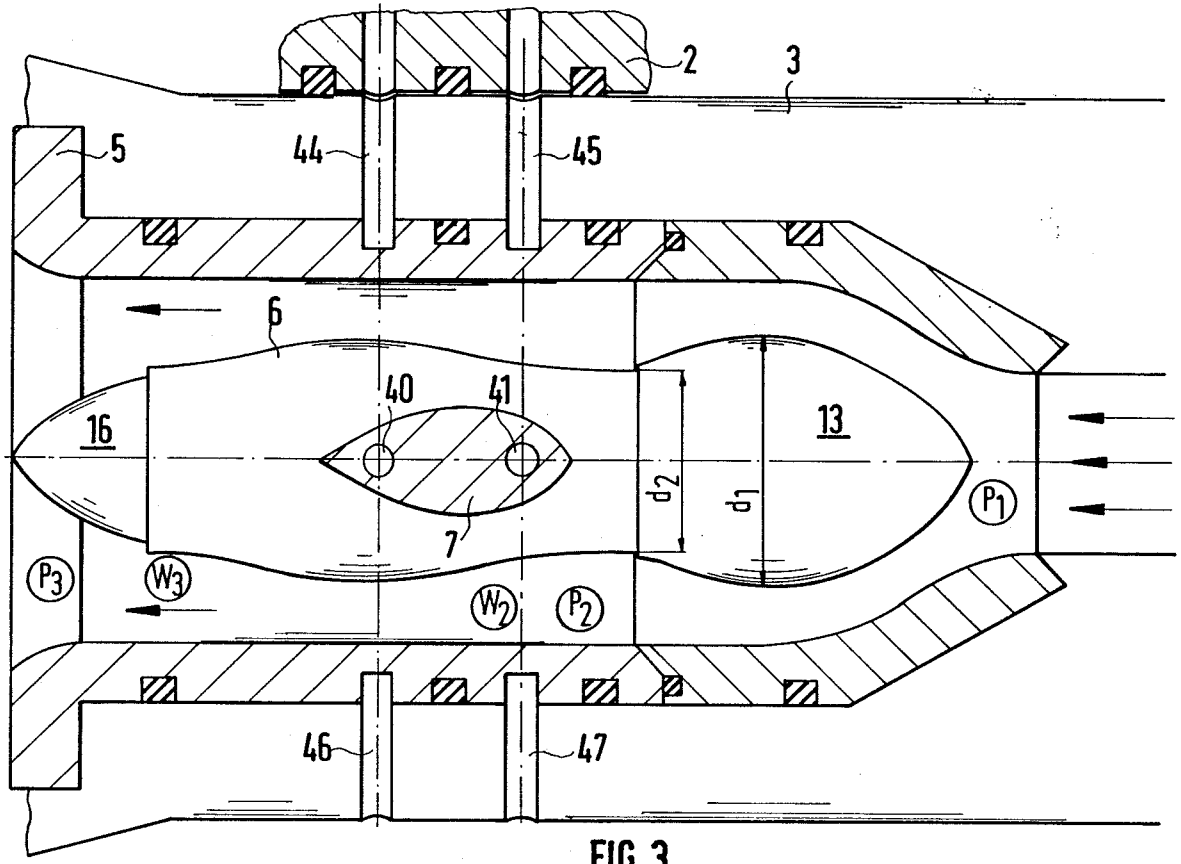
FIG. 3 is a sectional view taken along the plane III—III of FIG. 2.
Figure 4:
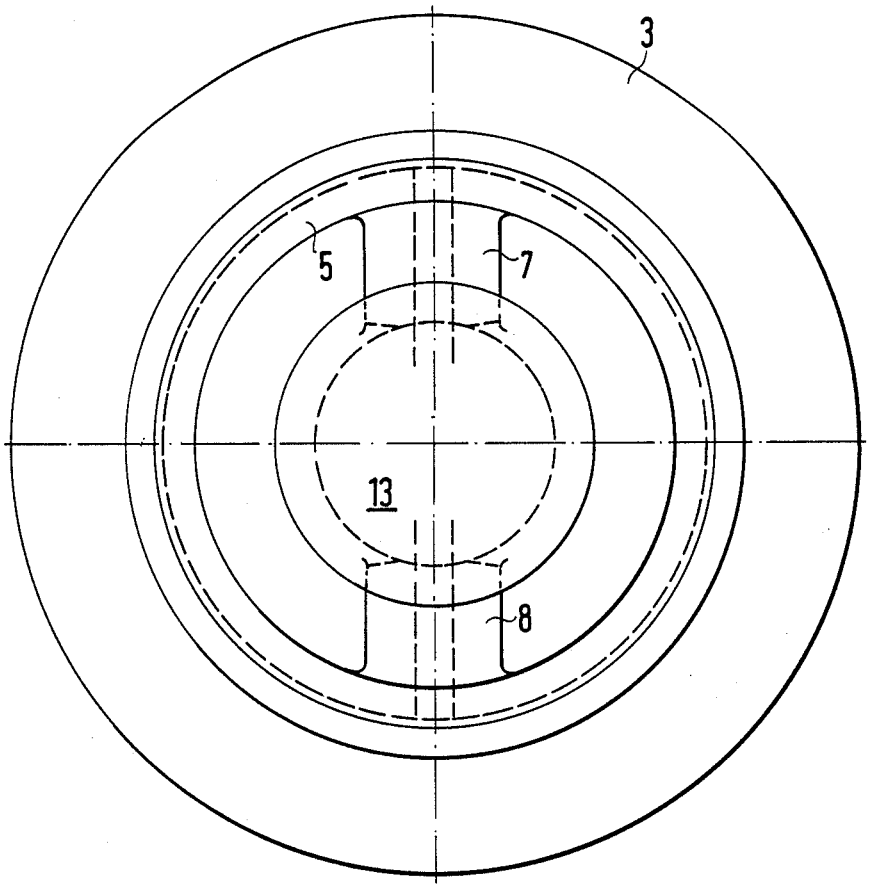
FIG. 4 is a view of the end of the inner pipe which faces in the direction of the approaching flow, with choker valve arranged inside it.

FIGS. 2 and 3 show yet another type of construction of the invention. Parts, common to FIGS. 1, 2 and 3, bear the same reference numbers. Caps 13 and 16, shown in FIGS. 2 and 3, differ from those of the choker valve in FIG. 1 in that they are hydraulically or pneumatically activated. Thus, neither a rotary piston nor the fork rockers are needed. Instead, the cross-pieces are provided with channels 40 and 41, as well as channels 42 and 43, which align with channels 44 and 47 in the inner pipe 3. The channels 40 through 47 are loaded by a pressure-providing means (not shown), located in the outer pipe 2. The channels 40 through 43 open into two separate, unconnected chambers 48 and 49 in the housing 6. According to the desired direction of displacement of the caps 13 and 16, the pressure-transmitting medium flows into either of the chambers 48 and 49 and, thus, either presses cap 13 towards the aperture 12, or cap 16 towards the opposite aperture in the basic piece 5 results in the operation of pressure pulses in the flow of the liquid, alluded to before. The possibility for hydrostatic pressure compensation is given when a corresponding diameter ratio of d1, d2 and d3 is established.

If w1 is=w2=w3=0, then—not taking into consideration the axial system range (static head)- p1 is=p2=p3 and via $d1^2 - d2^2 \approx d3^2$, due to the outer flow (w=0)

v1 is=v2=0.

This means that the flow drag body (caps 13 and 16 plus the housing 6) is hydrostatically fully compensated for, and that external compressive forces cannot cause it to be axially displaced.

If w1 is≠w2≠w3, then—by means of the Bernouilli equation p1 is≠p2≠p3.

That means that—via $w3 < w2 < w1$ and $d1^2 - d2^2 \approx d3^2$ and allowing for the flow losses due to contour, surface and flow condition changes, the system operates hydrodynamically, partial-pressure-compensated*, and partly power-compensated (axially).

We claim:

1. A choker valve assembly for a target drill rod, said drill rod having an outer pipe, an inner pipe within said outer pipe and measuring means in said outer pipe for measuring functions of said drill rod, said measuring means having channels providing hydraulic signals in response to the data, said inner pipe having wall means for defining a flushing flow passage axially therethrough, said valve assembly comprising:

a body within said flow passage nonrotatably connected to said wall means and having means defining a tapered restriction portion in said flow passage;

a valve housing within said passage axially spaced from said restriction portion;

connecting means for non-rotatably connecting said housing within said passage;

a valve element supported by said housing and displaceable axially in said passage; and drive means extending between said measuring means and said valve element for causing axial movement of said valve element in response to said hydraulic signals, a portion of said drive means being located externally of said housing.

2. The choker valve assembly in claim 1 in which said connecting means includes a pair of cross-pieces extending between said housing and said body, in which said housing is open at both ends and in which said valve element is slidably guided within and sealed against said housing.

3. The choker valve assembly in claim 2 in which said valve element includes a pair of streamlined caps displaceable in the axial direction, wherein one of said caps is facing the direction of approaching fluid and extends outside the perimeter of said housing and further wherein the other of said caps is facing away from the direction of approaching fluid and is positioned within the perimeter of said housing.

4. The choker valve assembly in claim 1 in which said drive means extends between said measuring means and said valve element through said connecting means.

5. The choker valve assembly in claim 4 in which said drive means includes a piston on said outer pipe and a rocker lever in said connecting means having a first end connected to said piston and a second end connected to said valve element.

6. The choker valve assembly in claim 5 in which said piston comprises a ring encircling said inner pipe and in which said drive means includes two said rocker levers.

7. The choker valve assembly in claim 4 in which said drive means includes two chambers in said housing, passage means for connecting each of said chambers to a different one of said channels aand actuating means responsive to pressure in one said chamber for displacing said valve element in one axial direction toward said restriction portion and responsive to pressure in the other said chamber for displacing said valve element in a second axial direction away from said restriction portion.

8. The choker valve assembly in claim 2 in which said drive means extends between said measuring means and said valve element through said connecting means.

9. The choker valve assembly in claim 8 in which said drive means includes a piston on said outer pipe and a rocker lever in said connecting means having a first end connected to said piston and a second end connected to said valve element.

10. The choker valve assembly in claim 9 in which said piston comprises a ring encircling said inner pipe and in which said drive means includes two said rocker levers.

11. The choker valve assembly in claim 8 in which said drive means includes two chambers in said housing, passage means for connecting each of said chambers to a different one of said channels and actuating means responsive to pressure in one said chamber for displacing said valve element in one axial direction toward said restriction portion and responsive to pressure in the other said chamber for displacing said valve element in a second axial direction away from said restriction portion.

12. The choker valve assembly in claim 3 in which said drive means extends between said measuring means and said valve element through said connecting means.

13. The choker valve assembly in claim 12 in which said drive means includes a piston on said outer pipe and a rocker lever in said connecting means having a first end connected to said piston and a second end connected to said valve element.

14. The choker valve assembly in claim 13 in which said piston comprises a ring encircling said inner pipe and in which said drive means includes two said rocker levers.

15. The choker valve assembly in claim 12 in which said drive means includes two chambers in said housing, passage means for connecting each of said chambers to a different one of said channels and actuating means responsive to pressure in one said chamber for displacing said valve element in one axial direction toward said restriction portion and responsive to pressure in the other said chamber for displacing said valve element in a second axial direction away from said restriction portion.

16. A choker valve assembly for a target drill rod, said drill rod having an outer pipe, an inner pipe within said outer pipe and measuring means in said outer pipe for measuring functions of said drill rod, said measuring means having channels for transmitting hydraulic signals in response to the measurement data, said inner pipe having wall means for defining a flushing fluid passage axially through which flushing fluid flows in a predetermined direction, said valve assembly comprising:

means defining a tapered restriction portion of said wall means;

a valve housing within said passage axially spaced from said restriction portion;

connecting means for non-rotatably connecting said housing to said wall of said inner pipe;

a valve element supported by said housing and displaceable axially in said passage;

drive means for causing axial movement of said valve element in response to said hydraulic signals;

a first streamlined cap on one end of said valve element facing the direction of flushing fluid flow, said cap extending outside the perimeter of said housing; and a second streamlined cap on a second end of said valve element facing away from the direction of flushing fluid flow of said second cap positioned within the perimeter of said housing.

17. The choker valve assembly in claim 16 in which said drive means extends between said measuring means and said valve element through said connecting means and in which a portion of said drive means is located externally of said housing.

* * * * *

UNITED STATES PATENT AND TRADEMARK OFFICE

CERTIFICATE OF CORRECTION

PATENT NO. : 4,784,229

DATED : November 15, 1988

INVENTOR(S) : Michael Ostkamper, Heinz Wallussek

It is certified that error appears in the above-identified patent and that said Letters Patent is hereby corrected as shown below:

Column 1, line 51:

"targeet" should be --target--;

Column 3, line 29:

"informtion" should be --information--;

Column 4, line 18:

Delete "inside";

Column 4, lines 51 and 52:

"electro-mechanicl" should be --electro-mechanical--;

Column 5, line 31:

After "housing" insert --. The --

Column 5, line 56:

"(not shownA)" should be -- (not shown) --;

Column 6, line 24:

After "5" insert --. This--;

Column 6, line 24:

"operation" should be --generation--;

Column 6, line 45:

"w1 ≠ w2 ≠ w3" should be --w1 = w2 - w3--;

UNITED STATES PATENT AND TRADEMARK OFFICE

CERTIFICATE OF CORRECTION

PATENT NO. : 4,784,229

DATED : November 15, 1988

INVENTOR(S) : Michael Ostkamper, Heinz Wallussek

It is certified that error appears in the above-identified patent and that said Letters Patent is hereby corrected as shown below:

;

Column 7, Claim 7, line 43:

"aand" should be --and--.

Signed and Sealed this

Twenty-ninth Day of August, 1989

*Attest:*

DONALD J. QUIGG

*Attesting Officer*

*Commissioner of Patents and Trademarks*